US012487025B2

(12) United States Patent
Schroeder et al.

(10) Patent No.: US 12,487,025 B2
(45) Date of Patent: Dec. 2, 2025

(54) REFRIGERATOR APPLIANCE INCLUDING MULTIPLE INSULATION FOAMS

(71) Applicant: Haier US Appliance Solutions, Inc., Wilmington, DE (US)

(72) Inventors: Michael Goodman Schroeder, Crestwood, KY (US); Kenneth R. Davis, Jr., Louisville, KY (US); Brent Alden Junge, Louisville, KY (US); Roger S. Nelson, Louisville, KY (US); Nicholas Tackett, Shepherdsville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 185 days.

(21) Appl. No.: 18/492,956

(22) Filed: Oct. 24, 2023

(65) Prior Publication Data

US 2025/0129983 A1 Apr. 24, 2025

(51) Int. Cl.
*F25D 23/06* (2006.01)

(52) U.S. Cl.
CPC ..... *F25D 23/062* (2013.01); *F25D 23/066* (2013.01); *F25D 2201/126* (2013.01)

(58) Field of Classification Search
CPC .... F25D 23/062; F25D 23/065; F25D 23/066; F25D 2323/06
See application file for complete search history.

(56) References Cited

U.S. PATENT DOCUMENTS

| | | | | |
|---|---|---|---|---|
| 5,066,437 | A * | 11/1991 | Barito | F25D 23/06 264/102 |
| 8,128,992 | B1 * | 3/2012 | Tobbe | F25D 23/064 427/236 |
| 11,035,607 | B2 * | 6/2021 | Naik | F25D 23/06 |
| 2013/0257257 | A1 * | 10/2013 | Cur | F25D 23/062 156/286 |
| 2017/0176090 | A1 * | 6/2017 | Allard | B32B 27/065 |
| 2018/0133937 | A1 * | 5/2018 | Amodeo | B29C 33/20 |
| 2019/0128593 | A1 * | 5/2019 | Deka | F16L 59/065 |
| 2022/0341656 | A1 * | 10/2022 | Betz | F25D 23/063 |
| 2024/0361068 | A1 * | 10/2024 | Allard | F25D 23/063 |

FOREIGN PATENT DOCUMENTS

| | | | |
|---|---|---|---|
| CN | 114102957 | A | 3/2022 |
| JP | 6655277 | B2 | 2/2020 |
| JP | 6877223 | B2 | 5/2021 |
| KR | 101260559 | B1 | 5/2013 |

OTHER PUBLICATIONS

English translation of JP 6877223 from espacnet (Year: 2025).*

* cited by examiner

*Primary Examiner* — Daniel J Rohrhoff
(74) *Attorney, Agent, or Firm* — Dority & Manning, P.A.

(57) ABSTRACT

A refrigerator appliance includes a cabinet defining an insulation receiving space between an outer casing and an inner liner, a dividing wall positioned within the insulation receiving space to divide the insulation receiving space into a first portion and a second portion, a first injection site for a first foam, and a second injection site for a second foam. The dividing wall includes one or more apertures therethrough.

18 Claims, 5 Drawing Sheets

REFRIGERATOR APPLIANCE INCLUDING MULTIPLE INSULATION FOAMS

FIELD OF THE INVENTION

The present subject matter relates generally to refrigerator appliances, and more particularly to insulation for refrigerator appliance cabinets.

BACKGROUND OF THE INVENTION

Refrigerator appliances generally include a cabinet defining one or more storage chambers, such as a fresh food chamber or a freezer chamber. Each of the storage chambers contains items which users desire to keep in a relatively cooled state, as compared to an ambient atmosphere. Such cabinets may include an insulation or insulating material to prevent heat exchange from the storage chambers to the ambient atmosphere. In some instances, a foam insulation is used between an outer casing and an inner casing.

However, existing refrigerator appliances have certain drawbacks. For one example, a single insulation may be inefficient across multiple temperature differences. For another example, existing applications of the insulation to the cabinet may result in incomplete filling, thus degrading the effectiveness of the insulation. Accordingly, a refrigerator appliance which obviates one or more of the above-mentioned drawbacks would be beneficial. In particular, a refrigerator appliance with improved insulation applications would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a refrigerator appliance is provided. The refrigerator appliance may include a cabinet including a fresh food chamber and a freezer chamber, the cabinet including an outer casing and an inner liner spaced apart from the outer casing, wherein an insulation receiving space is defined between the outer casing and the inner liner; a first injection site adjacent to the fresh food chamber, the first injection site allowing fluid communication between a first portion of the insulation receiving space and an ambient atmosphere; a second injection site adjacent to the freezer chamber, the second injection site allowing fluid communication between a second portion of the insulation receiving space and the ambient atmosphere, the second portion being adjacent to the first portion and separated at a predetermined knit line; a first insulation foam provided within the first portion of the insulation receiving space, wherein the first insulation foam includes a first blowing agent; and a second insulation foam provided within the second portion of the insulation receiving space, wherein the second insulation foam includes a second blowing agent different from the first blowing agent.

In another exemplary aspect of the present disclosure, a refrigerator appliance is provided. The refrigerator appliance may include a cabinet including a fresh food chamber and a freezer chamber, the cabinet including an outer casing and an inner liner spaced apart from the outer casing, wherein an insulation receiving space is defined between the outer casing and the inner liner; a mullion separating the fresh food chamber from the freezer chamber; a dividing wall provided within the insulation receiving space, wherein the dividing wall extends along the transverse direction from a front inner surface of the cabinet to a rear inner surface of the cabinet at a first lateral edge thereof, along the lateral direction from a first inner lateral surface of the cabinet to a second inner lateral surface of the cabinet, and along the transverse direction from the rear inner surface of the cabinet to the front inner surface of the cabinet at a second lateral edge thereof; a first injection site adjacent to the fresh food chamber, the first injection site allowing fluid communication between a first portion of the insulation receiving space and an ambient atmosphere; and a second injection site adjacent to the freezer chamber, the second injection site allowing fluid communication between a second portion of the insulation receiving space and the ambient atmosphere, the second portion being adjacent to the first portion and separated at a predetermined knit line.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
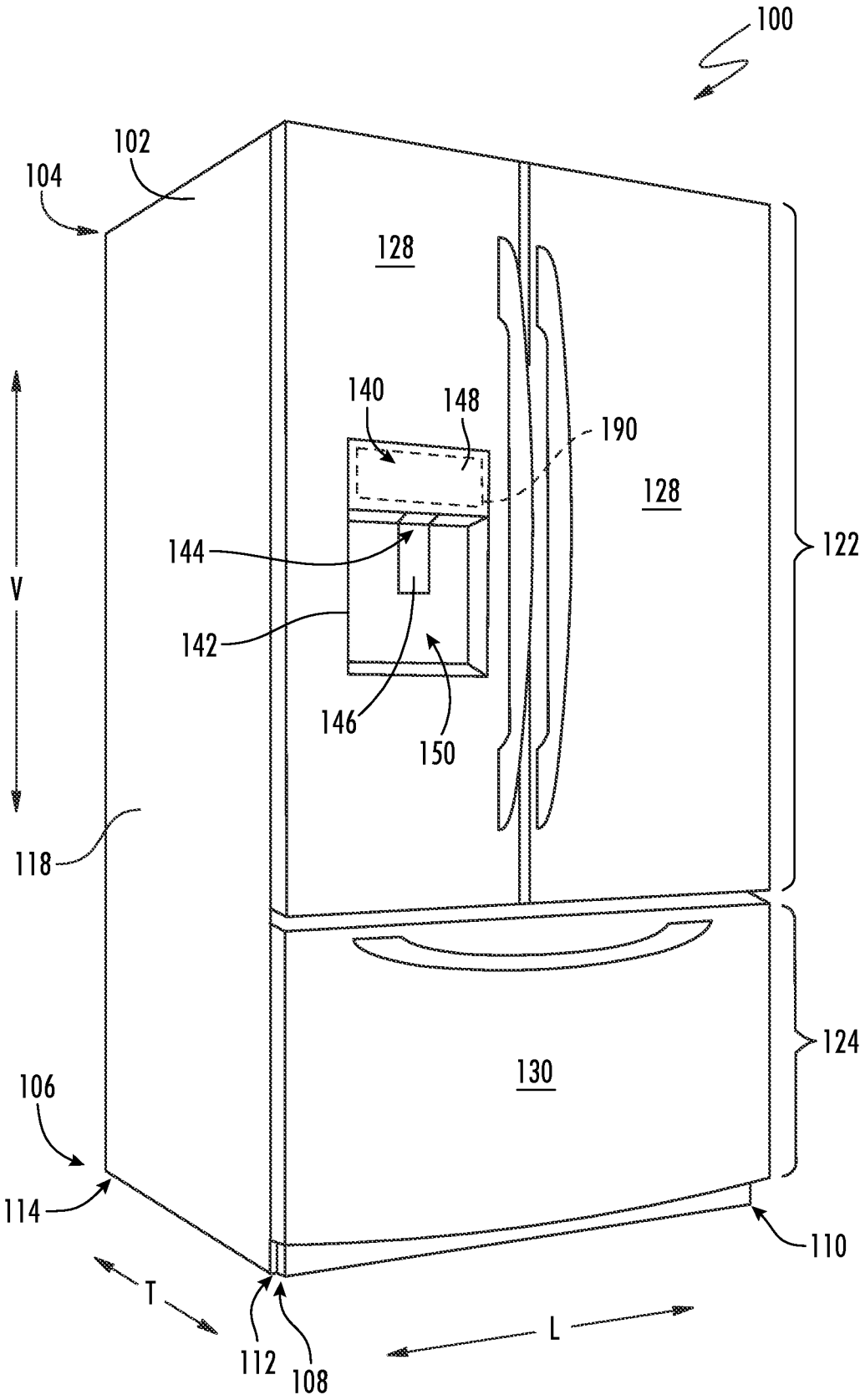
FIG. 1 provides a perspective view of a refrigerator appliance according to an exemplary embodiment of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
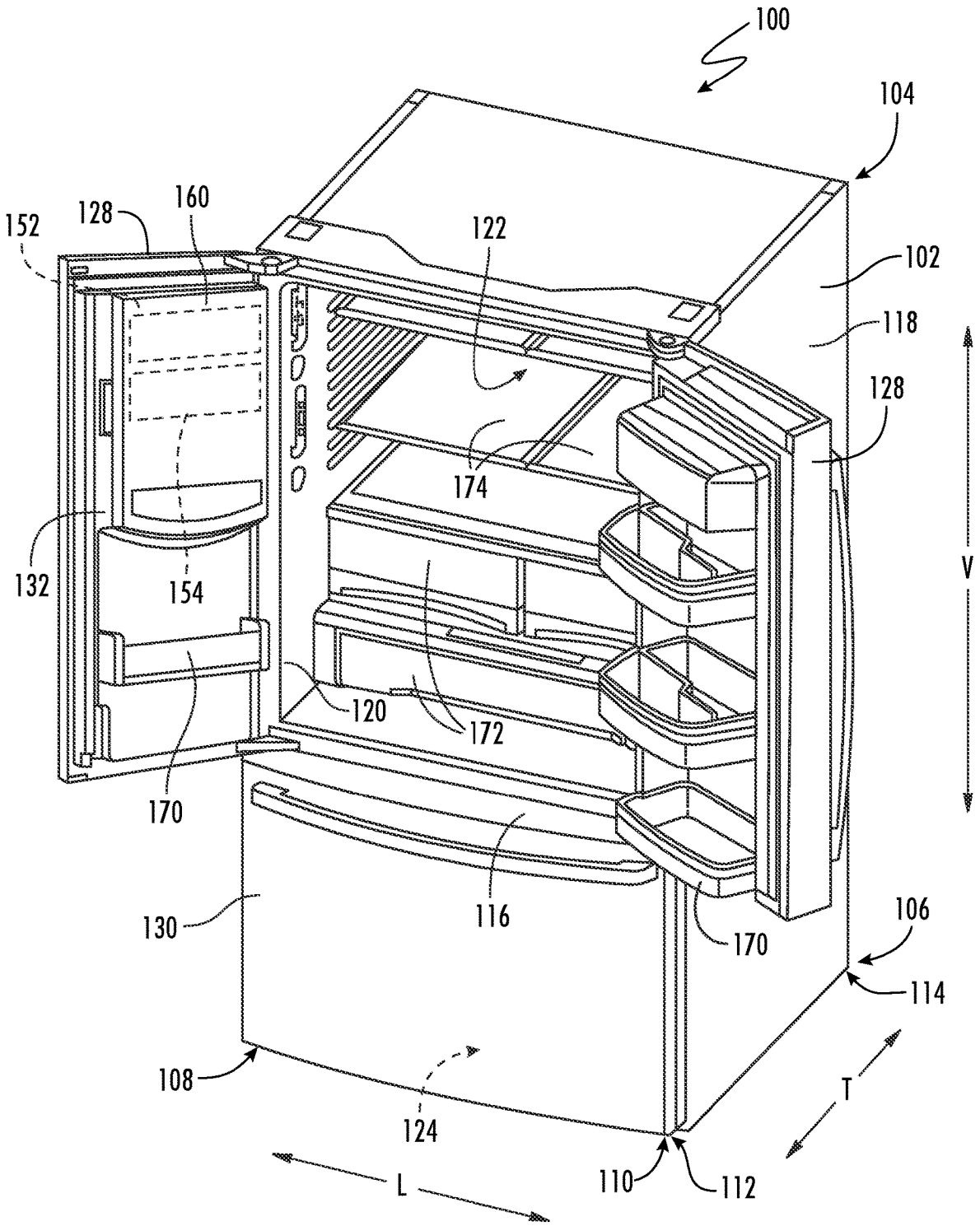
FIG. 2 provides a perspective view of the exemplary refrigerator appliance shown in FIG. 1, wherein a refrigerator door is in an open position according to an exemplary embodiment of the present disclosure.

Turning to the figures, FIGS. 1 and 2 illustrate perspective views of an example appliance (e.g., a refrigerator appliance 100). Refrigerator appliance 100 may include a housing or cabinet 102 having an outer casing 118. As shown, cabinet 102 generally extends between a top 104 and a bottom 106 along a vertical direction V, between a first side 108 and a second side 110 along a lateral direction L, and between a front side 112 and a rear side 114 along a transverse direction T. Each of the vertical direction V, lateral direction L, and transverse direction T are mutually perpendicular to one another and form an orthogonal direction system.

As shown, cabinet 102 generally defines chilled chambers for receipt of food items for storage. In particular, cabinet 102 may define a fresh food chamber 122 adjacent to top 104 of cabinet 102 and a freezer chamber 124 arranged adjacent to bottom 106 of cabinet 102. As such, refrigerator appliance 100 may be generally referred to as a bottom mount refrigerator. It is recognized, however, that the benefits of the present disclosure apply to other types and styles of refrigerator appliances such as, e.g., a top mount refrigerator appliance or a side-by-side style refrigerator appliance. Consequently, the description set forth herein is for illustrative purposes only and is not intended to be limiting in any aspect to any particular refrigerator chamber configuration.

According to the illustrated embodiment, various storage components are mounted within fresh food chamber 122 to facilitate storage of food items therein as will be understood by those skilled in the art. In particular, the storage components may include bins 170, drawers 172, and shelves 174 that are mounted within fresh food chamber 122. Bins 170, drawers 172, and shelves 174 may be positioned to receive of food items (e.g., beverages and/or solid food items) and may assist with organizing such food items. As an example, drawers 172 can receive fresh food items (e.g., vegetables, fruits, and/or cheeses) and increase the useful life of such fresh food items. In some embodiments, a lateral mullion 116 is positioned within cabinet 102 and separating freezer chamber 124 and the fresh food chamber 122 along a vertical direction V.

Refrigerator doors 128 may be rotatably hinged to an edge of cabinet 102 for selectively accessing fresh food chamber 122 and extending across at least a portion of fresh food chamber 122. In addition, a freezer door 130 may be arranged below refrigerator doors 128 for selectively accessing freezer chamber 124 and extending across at least a portion of freezer chamber 124. Freezer door 130 may be coupled to a freezer drawer (not shown) slidably mounted within freezer chamber 124. Refrigerator doors 128 and freezer door 130 are each shown in the closed position in FIG. 1 (i.e., a first closed position corresponding to doors 128, and a second closed position corresponding to door 130).

Refrigerator appliance 100 also includes a delivery assembly 140 for delivering or dispensing liquid water and/or ice. Delivery assembly 140 may include a dispenser 142 positioned on or mounted to an exterior portion of refrigerator appliance 100, e.g., on one of refrigerator doors 128. Dispenser 142 may include a discharging outlet 144 for accessing ice and liquid water. An actuating mechanism 146, shown as a paddle, may be mounted below discharging outlet 144 for operating dispenser 142. In alternative example embodiments, any suitable actuating mechanism may be used to operate dispenser 142. A user interface panel 148 may be provided for directing (e.g., selecting) the mode of operation.

Discharging outlet 144 and actuating mechanism 146 are an external part of dispenser 142 and are mounted in a dispenser recess 150. Dispenser recess 150 may be positioned at a predetermined elevation convenient for a user to access ice or water and enabling the user to access ice without the need to bend-over and without the need to open refrigerator doors 128. During certain operations, the dispensing assembly 140 may receive ice from an icemaker 152 mounted in a sub-compartment of the fresh food chamber 122.

Operation of the refrigerator appliance 100 can be generally controlled or regulated by a controller 190. In some embodiments, controller 190 is operably coupled to user interface panel 148 and/or various other components, as will be described below. User interface panel 148 provides selections for user manipulation of the operation of refrigerator appliance 100. As an example, user interface panel 148 may provide for selections between whole or crushed ice, chilled water, and/or specific modes of operation. In response to one or more input signals (e.g., from user manipulation of user interface panel 148 and/or one or more sensor signals), controller 190 may operate various components of the refrigerator appliance 100 according to the current mode of operation.

Controller 190 may include a memory and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In some embodiments, the processor executes programming instructions stored in memory. The memory may be a separate component from the processor or may be included onboard within the processor. Additionally or alternatively, controller 190 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 190, or portions thereof, may be positioned in a variety of locations throughout refrigerator appliance 100. In example embodiments, controller 190 is located within the user interface panel 148. In other embodiments, the controller 190 may be positioned at any suitable location within refrigerator appliance 100, such as for example within the fresh food chamber 122, a freezer door 130, etc. Input/output ("I/O") signals may be routed between controller 190 and various operational components of refrigerator appliance 100. For example, user interface panel 148 may be operably coupled to controller 190 via one or more signal lines or shared communication busses.

FIG. 2 provides a perspective view of refrigerator appliance 100 shown with refrigerator doors 128 in the open position. As shown, an icebox liner 132 defining a sub-compartment (e.g., icebox compartment 160) is attached to cabinet 102. For instance, in some embodiments, at least one door 128 includes icebox liner 132 positioned thereon. In turn, icebox compartment 160 may be defined within one of doors 128. In some such embodiments, icebox compartment 160 extends into fresh food chamber 122 when refrigerator door 128 is in the closed position. Although icebox compartment 160 is shown in door 128, additional or alterative embodiments may include an icebox compartment defined at another portion of refrigerator appliance 100 (e.g., within door 130 or fresh food chamber 122). An ice making assembly or icemaker 152 may be positioned or mounted within icebox compartment 160. Ice may be supplied to dispenser recess 150 (FIG. 1) from icemaker 152 in icebox compartment 160 on a back side of refrigerator door 128.

In some embodiments, one or more of icemaker 152 and an ice bucket or storage bin 154 are provided within icebox compartment 160. Icemaker 152 may be any suitable assembly for generating ice from liquid water, such as a rigid cube, soft-ice, or nugget ice making assembly. Ice storage bin 154 may be positioned to receive and/or store ice from icemaker 152. Optionally, ice storage bin 154 is positioned below icemaker 152 and receives therefrom. For instance, an ice chute (not pictured) may be positioned adjacent to icemaker 152 to direct ice from icemaker 152 to ice bin 154. From ice storage bin 154, the ice can enter delivery assembly 140 and be accessed by a user.

Figure 3:
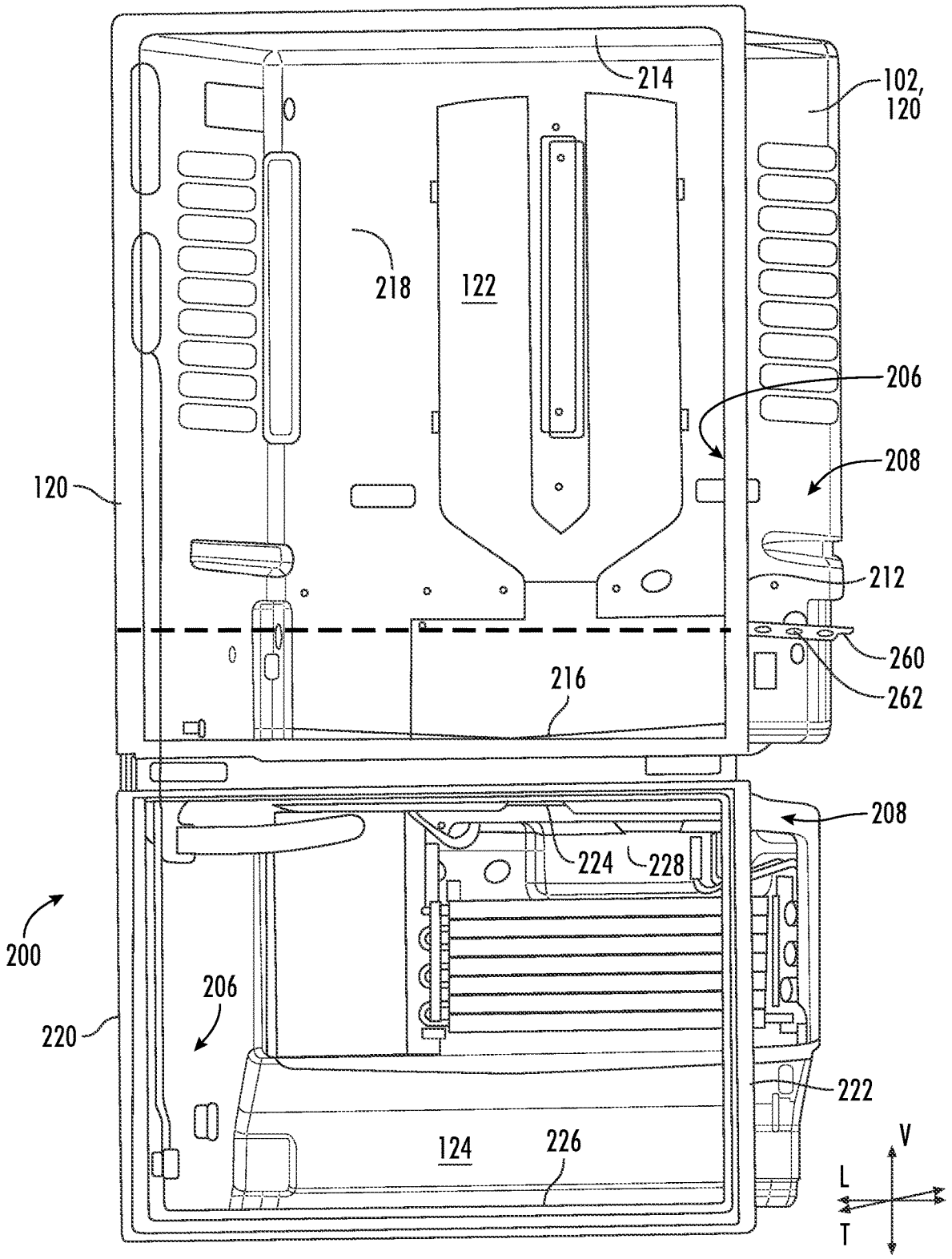
FIG. 3 provides a perspective view of an inner liner of a refrigerator appliance according to an exemplary embodiment of the present disclosure.
Figure 4:
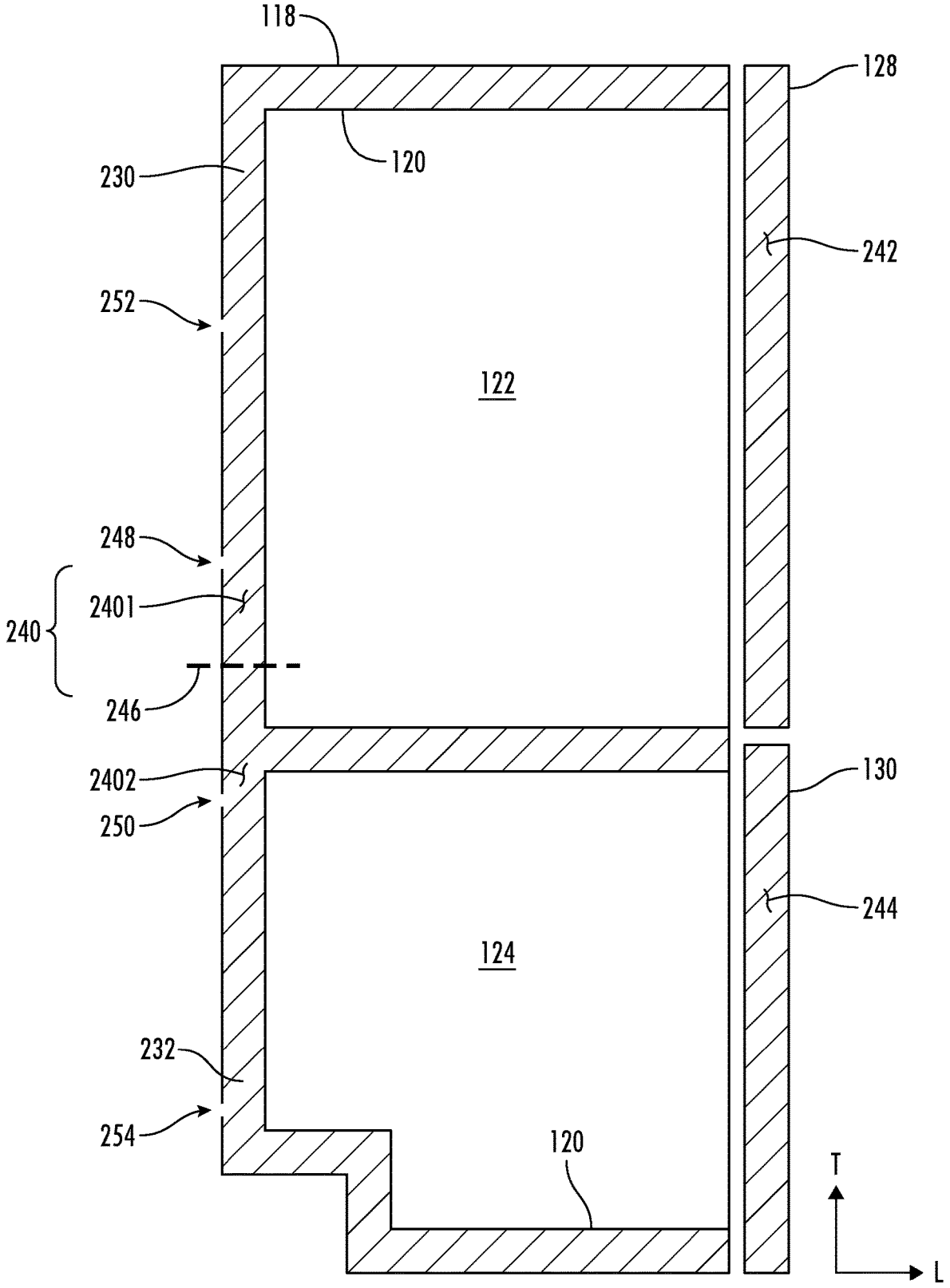
FIG. 4 provides a side section view of the exemplary refrigerator appliance of FIG. 1 showing an insulation receiving space.
Figure 5:
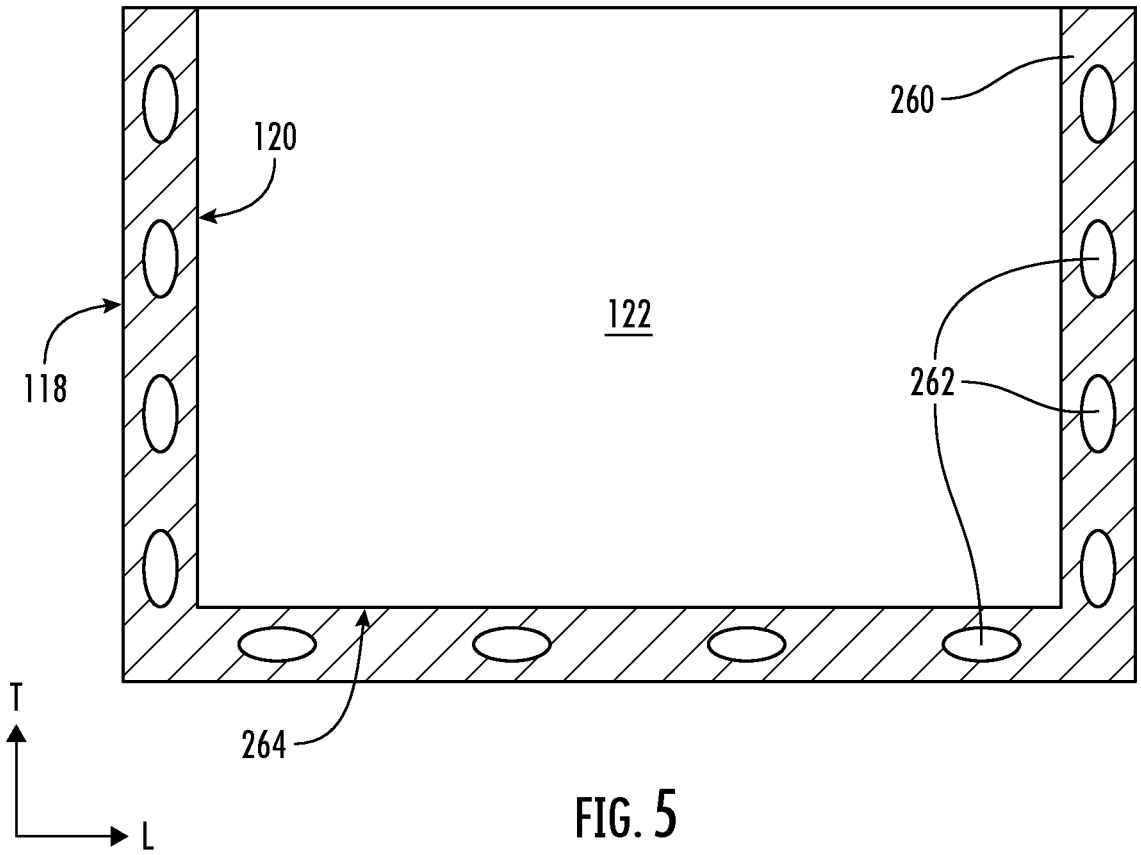
FIG. 5 provides a top section view of the exemplary refrigerator appliance of FIG. 1 showing a dividing wall.

Turning now to FIGS. 3 through 5, various views of components of refrigerator appliance 100, including inner liner 120 and a dividing wall 200, are provided. FIG. 3 provides a perspective view of an internal liner 120 of refrigerator appliance 100. FIG. 4 provides a side section view of refrigerator appliance 100 showing an insulation receiving space. FIG. 5 provides a top section view of refrigerator appliance 100, and further illustrates dividing wall 250.

As shown, inner or internal liner 120 generally defines fresh food chamber 122 and/or freezer chamber 124. Specifically, an inner surface 206 of internal liner 120 may define one or both of fresh food chamber 122 and freezer chamber 124. An opposite outer surface 208 of internal liner 120 may face away from inner surface 206 and the respective fresh food chamber 122 or freezer chamber 124.

Internal liner 120 may be formed from a single continuous integral component or, alternatively, from multiple connected pieces. When assembled, fresh food chamber 122 may be fluidly isolated from freezer chamber 124. For instance, both chamber 122 and chamber 124 may be isolated such that no air is exchanged between chambers 122, 124 when one or both of doors 128, 130 are closed.

In the illustrated embodiments, internal liner 120 includes a plurality of walls defining chambers 122, 124. Specifically, internal liner 120 includes a first and a second fresh food sidewall (210 and 212) spaced apart along the lateral direction L, as well as an upper and a lower fresh food wall (214 and 216) spaced apart along the vertical direction V. A rear fresh food wall 218 may join upper fresh food wall 214, lower fresh food wall 216, and fresh food sidewalls 210, 212 to define an internal extreme of fresh food chamber 122 along the transverse direction T (i.e., a point or plane of fresh food chamber 122 most proximal to rear side 114 of cabinet 102). Rear fresh food wall 218 may further be positioned opposite an opening defined between the transverse fresh food walls 210, 212, 214, 216 and selectively covered by doors 128. Internal liner 120 may further include a first and a second freezer sidewall (220 and 222) spaced apart along the lateral direction L, as well as an upper and a lower freezer wall (224 and 226) spaced apart along the vertical direction V. A rear freezer wall 228 may join upper freezer wall 224, lower freezer wall 226, and freezer sidewalls 220, 222 to define an internal extreme of freezer chamber 124 along the transverse direction T (i.e., a point or plane of freezer chamber 124 most proximal to rear side 114 of cabinet 102). Rear freezer wall 228 may further be positioned opposite an opening defined between the transverse freezer walls 220, 222, 224, 226 and selectively covered by door 130.

When assembled, internal liner 120 may be assembled at least partially within outer casing 118 (FIG. 1). Insulation (e.g., insulating foam) may be positioned between inner liner 120 and outer casing 118 along outer surface 208. Additionally or alternatively, insulation may be positioned along outer surface 208 between fresh food chamber 122 and freezer chamber 124 (e.g., within mullion 116). Accordingly, an insulation receiving space 240 (FIG. 4) may be formed between inner liner 120 and outer casing 118. For instance, as described briefly above, a gap (e.g., insulation receiving space 240) may be provided between outer casing 118 and inner lining 120. One or more insulation features may be provided within insulation receiving space 240 to insulate each of fresh food chamber 122 and freezer chamber 124 from the ambient atmosphere. As will be described below, according to some embodiments, one or more insulation foams may be supplied to insulation receiving space 240.

Additionally or alternatively, each of refrigerator door (or doors) 128 and freezer door 130 may include an insulation receiving space. For example, refrigerator door 128 may define a refrigerator door insulation receiving space (RDIRS) 242 and freezer door 130 may define a freezer door insulation receiving space (FDIRS) 244. Accordingly, each of fresh food chamber 122 and freezer chamber 124 may be fully surrounded by insulation. As will be explained further each of RDIRS 242 and FDIRS 244 may include a separate and distinct insulation (e.g., insulation foam).

Insulation receiving space 240 may be divided into a plurality of portions. For one example, insulation receiving space 240 includes a first portion 2401 and a second portion 2402. However, three or more portions may be included within insulation receiving space 240 according to additional or alternative embodiments. First portion 2401 may be associated with one of the chambers of appliance 100 (e.g., fresh food chamber 122, freezer chamber 124, etc.). According to at least one embodiment, first portion 2401 is defined around fresh food chamber 122. Accordingly, second portion 2402 may be defined around freezer chamber 124. Additionally or alternatively, RDIRS 242 may be associated with first portion 2401 while FDIRS 244 may be associated with second portion 2402. Moreover, in some instances, second portion 2402 may include mullion 116.

First portion 2401 and second portion 2402 may be adjacent to each other (e.g., within insulation receiving space 240). For instance, first portion 2401 and second portion 2402 may adjoin each other at a knit line 246. In detail, when two distinct insulations (e.g., insulation foams) are supplied to insulation receiving space 240, the two distinct insulations may meet, engage, interact, or otherwise mesh with each other at knit line 246. According to at least one embodiment, and as shown in FIG. 4, knit line 246 may be defined along a horizontal plane (e.g., the lateral direction L and the transverse direction T), in the case of a bottom mount freezer or top mount freezer. According to additional or alternative embodiments (e.g., side-by-side appliances), knit line 246 may extend along a vertical plane (e.g., the vertical direction V and the transverse direction T).

Knit line 246 may be positioned at or near mullion 116. In some embodiments, as will be explained below, knit line 146 is predetermined (e.g., by a wall or barrier). Additionally or alternatively, knit line 246 may be naturally formed during an injection process of the insulations. For instance, a first insulation (first insulation foam) may be injected at a first site (described below) and a second insulation (second insulation foam) may be injected at a second site (described below). As each of the first insulation and the second insulation are injected, an expansion of the respective insulations (e.g., via a blowing agent) may cause the insulations to expand within insulation receiving space 240. Based on an injection rate, speed, or pressure combined with a specific location of injection, the first insulation and the second insulation may naturally meet at knit line 246. As would be understood, a precise location of knit line 246 may vary according to specific embodiments. For instance, a distance between mullion 116 and knit line 246 may vary by between about 10% and about 15%. However, knit line 246 may be positioned adjacent fresh food chamber 122 (e.g., above mullion 116 along the vertical direction V in a bottom freezer mount appliance 100). According to at least some embodiments, knit line 246 is defined at a location within about 8 inches from mullion 116 (e.g., along the vertical direction V).

Cabinet 102 may include a first injection site 248. For instance, first injection site 248 may be formed through outer casing 118. First injection site 248 may allow fluid communication between insulation receiving space 240 and the ambient atmosphere. First injection site 248 may include one or more openings (e.g., pouring holes) through which a fluid (e.g., insulation foam) can be injected into insulation receiving space 240. In some embodiments, one or more nozzles are provided at first injection site 248. For instance, the one or more nozzles may be removably attached to first injection site 248 to aid in supplying the insulation to insulation receiving space 240.

First injection site 248 may be positioned adjacent to first portion 2401 of insulation receiving space 240. For instance, first injection site 248 may penetrate outer casing 118 at first portion 2401 (e.g., adjacent to fresh food chamber 122). Thus, the fluid (e.g., insulation) supplied via first injection site 248 may be supplied to first portion 248. First injection site 248 may be positioned within a predetermined distance from of knit line 246. For instance, first injection site 248 may be positioned such that the fluid injected therethrough occupies first portion 2401 before seeping past knit line 246. Additionally or alternatively, one or more vent holes 252 may be formed through outer casing 118. For instance, vent holes 252 may be formed through outer casing 118 (e.g., along the transverse direction T). Accordingly, when an insulation is supplied to first portion 2401 via first injection site 248, air present within insulation receiving space 240 may escape via vent holes 252 to allow the insulation to occupy an entirety of first portion 2401.

A first insulation foam 230 may be supplied to first portion 2401 of insulation receiving space 240 via first injection site 248. First insulation foam 230 may have or exhibit particular insulative qualities. For instance, first insulation foam 230 may include specific thermal conductivity behaviors over particular temperature ranges. Accordingly, first insulation foam 230 may be particularly effective at reducing heat leakage over a predetermined temperature range (e.g., as associated with fresh food chamber 122). First insulation foam 230 may be any suitable insulation foam, such as a polyurethane foam, a rigid polyurethane foam, or the like. First insulation foam 230 may include one or more blowing agents, such as cyclopentane (CP), Forane® 141b, Solstice®, or the like. Additionally or alternatively, refrigerator door (or doors) 128 may be filled with first insulation foam 230. Accordingly, the first compartment (e.g., fresh food chamber 122) may be surrounded by first insulation foam 230.

Cabinet 102 may include a second injection site 250. For instance, second injection site 250 may be formed through outer casing 118. Second injection site 250 may allow fluid communication between insulation receiving space 240 and the ambient atmosphere. Second injection site 250 may include one or more openings (e.g., pouring holes) through which a fluid (e.g., insulation foam) can be injected into insulation receiving space 240. In some embodiments, one or more nozzles are provided at second injection site 250. For instance, the one or more nozzles may be removably attached to second injection site 250 to aid in supplying the insulation to insulation receiving space 240.

Second injection site 250 may be positioned adjacent to second portion 2402 of insulation receiving space 240. For instance, second injection site 250 may penetrate outer casing 118 at second portion 2402 (e.g., adjacent to freezer chamber 124). Thus, the fluid (e.g., insulation) supplied via second injection site 250 may be supplied to second portion 250. Second injection site 250 may be positioned within a predetermined distance from of knit line 246. For instance, second injection site 250 may be positioned such that the fluid injected therethrough occupies second portion 2402 before seeping past knit line 246. Additionally or alternatively, one or more vent holes 254 may be formed through outer casing 118. For instance, vent holes 254 may be formed through outer casing 118 (e.g., along the transverse direction T). Accordingly, when an insulation is supplied to second portion 2402 via second injection site 250, air present within insulation receiving space 240 may escape via vent holes 254 to allow the insulation to occupy an entirety of second portion 2402.

A second insulation foam 232 may be supplied to second portion 2401 of insulation receiving space 240 via second injection site 250. Second insulation foam 232 may have or exhibit particular insulative qualities. For instance, second insulation foam 232 may include specific thermal conductivity behaviors over particular temperature ranges. Accordingly, second insulation foam 232 may be particularly effective at reducing heat leakage over a predetermined temperature range (e.g., as associated with freezer chamber 124). Second insulation foam 232 may be any suitable insulation foam, such as a polyurethane foam, a rigid polyurethane foam, or the like. Second insulation foam 232 may include one or more blowing agents, such as CP, Forane® 141b, Solstice®, or the like. Additionally or alternatively, freezer door 130 may be filled with second insulation foam 232. Accordingly, the second compartment (e.g., freezer chamber 122) may be surrounded by second insulation foam 232. As mentioned above, mullion 116 may be included with second portion 2402. Accordingly, second insulation foam 232 may be injected into mullion 116 (e.g., via second injection site 250).

Second insulation foam 232 may be different from first insulation foam 230. For instance, second insulation foam 232 may include a different blowing agent from first insulation foam 230. Thus, each of first portion 2401 and second portion 2402 may exhibit different thermal conductivity and thus different heat leak. Advantageously, a combination of performance and cost between the distinct insulation foams (e.g., blowing agents) can result in improved performance at a lower cost to manufacture.

Refrigerator appliance 100 may include a dividing wall 260. Dividing wall 260 may be positioned within insulation receiving space 240. For instance, dividing wall 260 may be positioned at or near knit line 246. Dividing wall 260 may be formed from any suitable material, such as a plastic, a metal, a compound, or the like. In some instances, dividing wall 260 may be integral with one of outer casing 118 or inner lining 120 (e.g., as one single piece). Dividing wall 260 may separate first portion 2401 of insulation receiving space 240 from second portion 2402 of insulation receiving space 240. Accordingly, dividing wall 260 may be a barrier between first insulation foam 230 and second insulation foam 232. In additional or alternative embodiments, dividing wall 260 includes a plurality of pieces (e.g., a first lateral piece, a rear transverse piece, a second lateral piece, etc.). Each of the plurality of pieces may be attached to each other (e.g., within insulation receiving space 240).

Dividing wall 260 may be in contact with each of outer casing 118 and inner lining 120. For instance, dividing wall 260 may contact an inner face of outer casing 118 and an outer face of inner lining 120. Additionally or alternatively, dividing wall 260 may extend from a front inner surface of outer casing 118 to a rear inner surface of outer casing 118 along the transverse direction T at a first lateral edge thereof, from a first inner lateral surface of outer casing 118 to a second inner lateral surface of outer casing 118 along the lateral direction L, and from the rear inner surface of outer casing 118 to the front inner surface of outer casing 118 along the transverse direction T at a second lateral edge thereof opposite the first lateral edge. Thus, dividing wall 118 may form a "C" shape (e.g., as viewed downward along the vertical direction V in FIG. 5).

Dividing wall 260 may include a plurality of apertures 262. In detail, one or more apertures 262 may be defined through dividing wall 262 along the vertical direction V. Apertures 262 may allow fluid communication between first portion 2401 and second portion 2402 of insulation receiving space 240. Apertures 262 may be spaced apart along dividing wall 260 (e.g., along the lateral direction L and the transverse direction T). Additionally or alternatively, apertures 262 may be staggered to allow for airflow in multiple directions (e.g., during a filling process of insulation foam into insulation receiving space 240). Apertures 262 may have any suitable shape, such as oval (e.g., as shown in FIG. 5), circular, square, rectangular, or the like. Moreover, apertures may have varying sizes (e.g., varying diameters).

In some embodiments, inner liner 120 may include a predetermined coating 264. For instance, inner liner 120 may be coated with a nonreactive coating 264 with respect to each of first insulation foam 230 and second insulation foam 232. Predetermined coating 264 may be applied to one or more additional elements within insulation receiving space 240 (e.g., ducting, evaporators, sensors, etc.). Advantageously, any insulation foam applied to insulation receiving space 240 may be restricted from damaging inner liner 120 or any components provided within insulation receiving space 240.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance defining a vertical direction, a lateral direction, and a transverse direction, the refrigerator appliance comprising:

a cabinet comprising a fresh food chamber and a freezer chamber, the cabinet comprising:

an outer casing; and an inner liner spaced apart from the outer casing, wherein an insulation receiving space is defined between the outer casing and the inner liner;

a first injection site adjacent to the fresh food chamber, the first injection site allowing fluid communication between a first portion of the insulation receiving space and an ambient atmosphere;

a second injection site adjacent to the freezer chamber, the second injection site allowing fluid communication between a second portion of the insulation receiving space and the ambient atmosphere, the second portion being adjacent to the first portion and separated at a predetermined knit line;

a first insulation foam provided within the first portion of the insulation receiving space, wherein the first insulation foam comprises a first blowing agent;

a second insulation foam provided within the second portion of the insulation receiving space, wherein the second insulation foam comprises a second blowing agent different from the first blowing agent; and a dividing wall provided in the insulation receiving space at the predetermined knit line, the dividing wall separating the first portion and the second portion of the insulation receiving space, wherein the dividing wall comprises one or more apertures therethrough along the vertical direction.

2. The refrigerator appliance of claim 1, wherein the cabinet further comprises a mullion separating the fresh food chamber from the freezer chamber.

3. The refrigerator appliance of claim 2, wherein the predetermined knit line is defined at a location within 8 inches from the mullion along the vertical direction.

4. The refrigerator appliance of claim 1, wherein the first injection site comprises at least one through-hole formed through the casing at the first portion.

5. The refrigerator appliance of claim 4, wherein the first injection site is positioned within a predetermined distance of the predetermined knit line.

6. The refrigerator appliance of claim 1, wherein the inner liner comprises a predetermined coating, the predetermined coating being nonreactive with each of the first insulation foam and the second insulation foam.

7. The refrigerator appliance of claim 1, further comprising:

at least one refrigerator door movably coupled to the cabinet to provide selective access to the fresh food chamber, the at least one refrigerator door being filled with the first insulation foam; and a freezer door movably coupled to the cabinet to provide selective access to the freezer chamber, the freezer door being filled with the second insulation foam.

8. A refrigerator appliance defining a vertical direction, a lateral direction, and a transverse direction, the refrigerator appliance comprising:

a cabinet comprising a fresh food chamber and a freezer chamber, the cabinet comprising:

an outer casing; and an inner liner spaced apart from the outer casing, wherein an insulation receiving space is defined between the outer casing and the inner liner;

a mullion separating the fresh food chamber from the freezer chamber;

a dividing wall provided within the insulation receiving space, wherein the dividing wall extends along the transverse direction abutting a front inner surface of the cabinet to abut a rear inner surface of the cabinet at a first lateral edge thereof, along the lateral direction abutting a first inner lateral surface of the cabinet to abut a second inner lateral surface of the cabinet, and along the transverse direction abutting the rear inner surface of the cabinet to abut the front inner surface of the cabinet at a second lateral edge thereof;

a first injection site adjacent to the fresh food chamber, the first injection site allowing fluid communication between a first portion of the insulation receiving space and an ambient atmosphere; and a second injection site adjacent to the freezer chamber, the second injection site allowing fluid communication between a second portion of the insulation receiving space and the ambient atmosphere, the second portion being adjacent to the first portion and separated at a predetermined knit line.

9. The refrigerator appliance of claim 8, further comprising:

a first insulation foam provided within the first portion of the insulation receiving space, wherein the first insulation foam comprises a first blowing agent; and a second insulation foam provided within the second portion of the insulation receiving space, wherein the second insulation foam comprises a second blowing agent different from the first blowing agent.

10. The refrigerator appliance of claim 9, further comprising:

at least one refrigerator door movably coupled to the cabinet to provide selective access to the fresh food chamber, the at least one refrigerator door being filled with the first insulation foam; and a freezer door movably coupled to the cabinet to provide selective access to the freezer chamber, the freezer door being filled with the second insulation foam.

11. The refrigerator appliance of claim 9, wherein the inner liner comprises a predetermined coating, the predetermined coating being nonreactive with each of the first insulation foam and the second insulation foam.

12. The refrigerator appliance of claim 8, wherein the predetermined knit line is defined at a location within 8 inches from the mullion along the vertical direction.

13. The refrigerator appliance of claim 8, wherein the dividing wall separates the first portion and the second portion of the insulation receiving space.

14. The refrigerator appliance of claim 13, wherein the dividing wall comprises one or more apertures therethrough along the vertical direction.

15. The refrigerator appliance of claim 8, wherein the first injection site comprises at least one through-hole formed through the casing at the first portion.

16. The refrigerator appliance of claim 15, wherein the first injection site is positioned within a predetermined distance of the predetermined knit line.

17. A refrigerator appliance defining a vertical direction, a lateral direction, and a transverse direction, the refrigerator appliance comprising:

a cabinet comprising a fresh food chamber and a freezer chamber, the cabinet comprising:

an outer casing; and an inner liner spaced apart from the outer casing, wherein an insulation receiving space is defined between the outer casing and the inner liner;

a dividing wall provided in the insulation receiving space, wherein the dividing wall separating the insulation receiving space into a first portion and a second portion, wherein the dividing wall abuts the outer casing and the inner liner, and wherein the dividing wall comprises one or more apertures therethrough along the vertical direction;

a first insulation foam provided within the first portion of the insulation receiving space; and a second insulation foam provided within the second portion of the insulation receiving space, wherein the second insulation foam is different than the first insulation foam.

18. The refrigerator appliance of claim 17, further comprising a mullion separating the fresh food chamber from the freezer chamber, wherein the dividing wall is located along the vertical direction adjacent to the mullion.

* * * * *